US008328195B2

(12) United States Patent
Rosacker et al.

(10) Patent No.: US 8,328,195 B2
(45) Date of Patent: Dec. 11, 2012

(54) EXIT PATH ASSEMBLY FOR AN IMAGING DEVICE

(75) Inventors: Robert Julian Rosacker, Georgetown, KY (US); Scott Stephen Williams, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 56 days.

(21) Appl. No.: 12/900,281

(22) Filed: Oct. 7, 2010

(65) Prior Publication Data

US 2012/0086165 A1 Apr. 12, 2012

(51) Int. Cl.
*B65H 39/10* (2006.01)

(52) U.S. Cl. ..... 271/301; 271/303; 271/304; 271/184; 271/185; 271/186

(58) Field of Classification Search ..... 271/301, 271/303, 304, 184–186, 3.01, 10.13
See application file for complete search history.

(56) References Cited

U.S. PATENT DOCUMENTS

| | | | | |
|---|---|---|---|---|
| 5,601,281 | A * | 2/1997 | Kubodera et al. | 271/10.04 |
| 6,522,860 | B2 * | 2/2003 | Nose et al. | 399/374 |
| 6,814,353 | B1 * | 11/2004 | Kakuta et al. | 271/186 |
| 6,983,122 | B2 | 1/2006 | Hayamizu et al. | |
| 7,431,293 | B2 * | 10/2008 | Carter et al. | 271/303 |
| 7,762,552 | B2 * | 7/2010 | Guerand et al. | 271/303 |
| 8,070,159 | B2 * | 12/2011 | Honda et al. | 271/301 |
| 2006/0023269 | A1 * | 2/2006 | Tsuchiya et al. | 358/498 |
| 2006/0214360 | A1 * | 9/2006 | Neuber et al. | 271/188 |
| 2008/0284090 | A1 * | 11/2008 | Honda et al. | 271/225 |
| 2009/0196667 | A1 | 8/2009 | Deckard et al. | |

* cited by examiner

*Primary Examiner* — Prasad Gokhale
(74) *Attorney, Agent, or Firm* — Justin M Tromp; John Victor Pezdek

(57) ABSTRACT

An exit path assembly for an imaging device according to one embodiment includes a first exit nip formed by a first roller and a second roller and a second exit nip formed by the second roller and a third roller. The rotational direction of the second roller is opposite the rotational direction of the first and third rollers. The exit path assembly further includes a common drive linkage for driving the rotation of the first, second and third rollers. The common drive linkage has a one-way clutch coupled to the third roller for limiting the drive of the third roller to one direction.

19 Claims, 6 Drawing Sheets

EXIT PATH ASSEMBLY FOR AN IMAGING DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present application relates generally to an imaging device and more particularly to an exit path assembly for an imaging device.

2. Description of the Related Art

In the imaging process used in imaging devices such as printers, copiers, and automatic document feed scanners, a series of rollers and/or belts advance media from a media storage location along a media path through an image transfer section or scanning section of the device. Image transfer may be achieved through the use of a photosensitive member such as a photosensitive drum or belt, a thermal inkjet device, a piezo-electric inkjet device, dye sublimation or any other image forming technology. The media is then advanced through an exit path to an output location for collecting the media.

The exit path may include one or more exit nips. For example, some devices include a pair of exit nips formed by three exit rollers. In operation, the top and bottom rollers rotate in the same direction while the middle roller rotates in the opposite direction. Accordingly, when the top nip rotates inward, the bottom nip rotates outward and vice versa. A first exit nip may be used to partially exit and then reenter a media sheet into the imaging device. Upon reentry, the media sheet is advanced through a duplex path in order to permit image transfer or scanning of a reverse side of the media sheet. This is known as a "peek-a-boo" duplex operation. A second exit nip may be used to deliver finished media to the output location.

The three exit rollers may share a common drive linkage. In this configuration, while a media sheet is partially exiting the imaging device during a peek-a-boo duplex operation, the second exit nip rotates inward. A problem may arise in some instances if one or more media sheets from the output location are unintentionally reintroduced into the imaging device by the inward rotation of the second exit nip. This can result in a media jam. Accordingly, it will be appreciated by those skilled in the art that a system and method for preventing the unintended reintroduction of media sheets into the imaging device from the output location is desired.

SUMMARY

An exit path assembly for an imaging device according to one embodiment includes a first exit nip formed by a first roller and a second roller and a second exit nip formed by the second roller and a third roller. The rotational direction of the second roller is opposite the rotational direction of the first and third rollers. The exit path assembly further includes a common drive linkage for driving the rotation of the first, second and third rollers. The common drive linkage has a one-way clutch coupled to the third roller for limiting the drive of the third roller to one direction.

An exit path assembly for an imaging device according to a second embodiment includes a first exit nip formed by a first roller and a second roller for performing peek-a-boo duplex printing and a second exit nip formed by the second roller and a third roller for outputting media sheets from the imaging device to an output bin disposed on the exterior of the imaging device. The rotational direction of the second roller is opposite the rotational direction of the first and third rollers. The exit path assembly further includes a common drive linkage for driving the rotation of the first, second and third rollers. The common drive linkage has a one-way clutch coupled to the third roller for limiting the drive of the third roller to one direction.

A method for transporting media in an imaging device according to one embodiment includes driving a first exit nip formed by a first roller and a second roller inward toward an interior of an imaging device housing while driving a second exit nip formed by the second roller and a third roller outward from the imaging device housing. The first, second and third rollers share a common drive linkage. The method further includes driving the first exit nip outward from the imaging device housing without driving the third roller. Some embodiments further include partially exiting a first media sheet from the imaging device housing through the first exit nip without driving the third roller and re-entering the first media sheet into the imaging device housing through the first exit nip while exiting a second media sheet from the imaging device housing through the second exit nip.

BRIEF DESCRIPTION OF THE DRAWINGS

The above-mentioned and other features and advantages of the various embodiments, and the manner of attaining them, will become more apparent and will be better understood by reference to the accompanying drawings, wherein.

DETAILED DESCRIPTION

Figure 1:
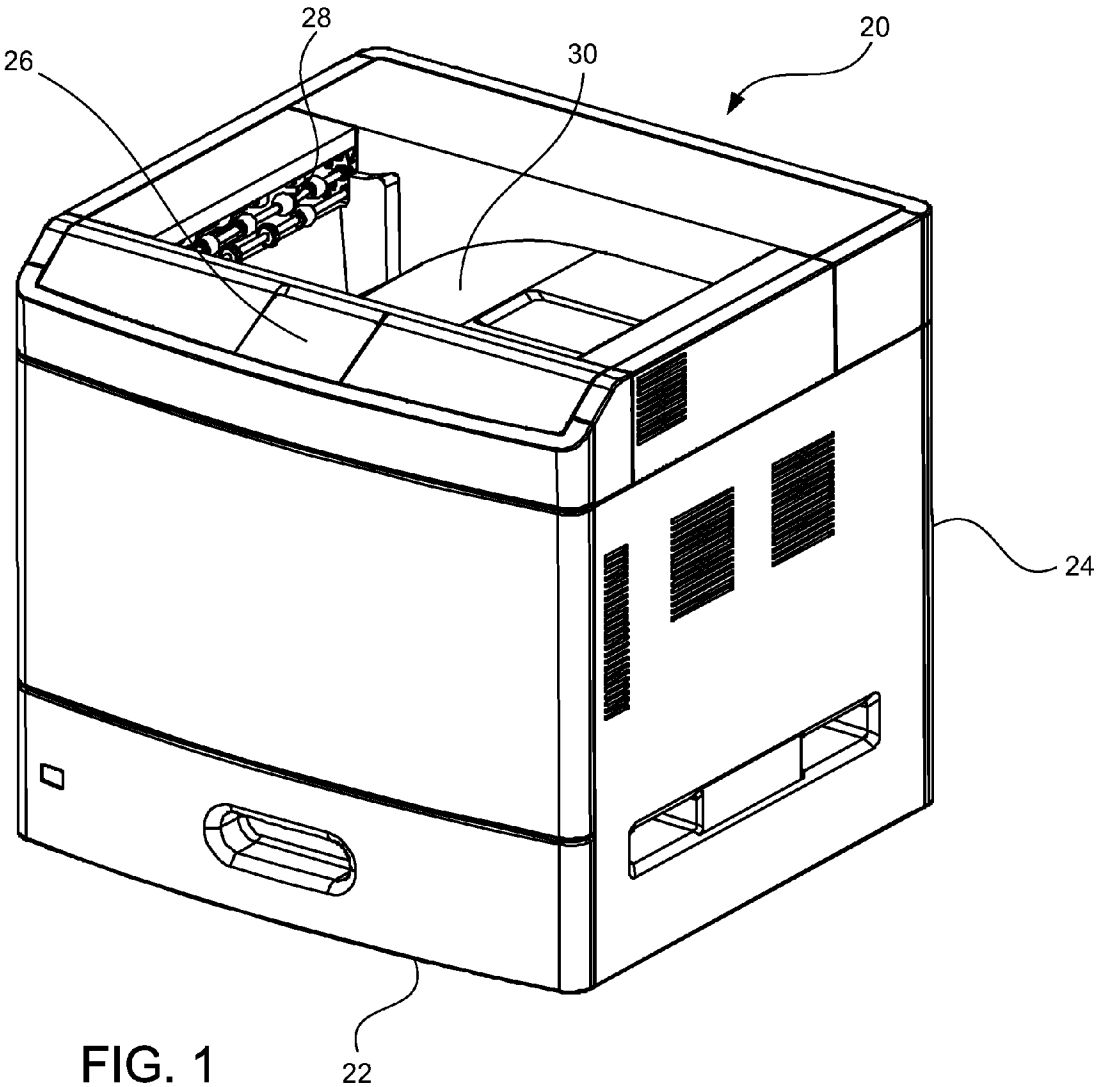
FIG. 1 shows a perspective view of an imaging device according to one embodiment.

The following description and drawings illustrate embodiments sufficiently to enable those skilled in the art to practice it. It is to be understood that the disclosure is not limited to the details of construction and the arrangement of components set forth in the following description or illustrated in the drawings. The invention is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense, and the scope of the present invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

FIG. 1 illustrates an example embodiment of an imaging device 20. The device 20 includes one or more input trays 22 positioned in a section of a housing 24. The trays 22 are sized to contain a stack of media sheets. As used herein, the term media is meant to encompass not only paper but also labels, envelopes, fabrics, photographic paper or any other desired substrate. The trays 22 are preferably removable for refilling. A control panel 26 may be located on the housing 24. Using the control panel 26, the user is able to enter commands and generally control the operation of the imaging device 20. For example, the user may enter commands to switch modes (e.g., color mode, monochrome mode), view the number of images printed or scanned, etc. The imaging device 20 includes an exit path assembly 28 for exiting media from the device and an output bin 30 disposed on the exterior of the imaging device 20 for receiving media from the exit path assembly 28.

Figure 2:
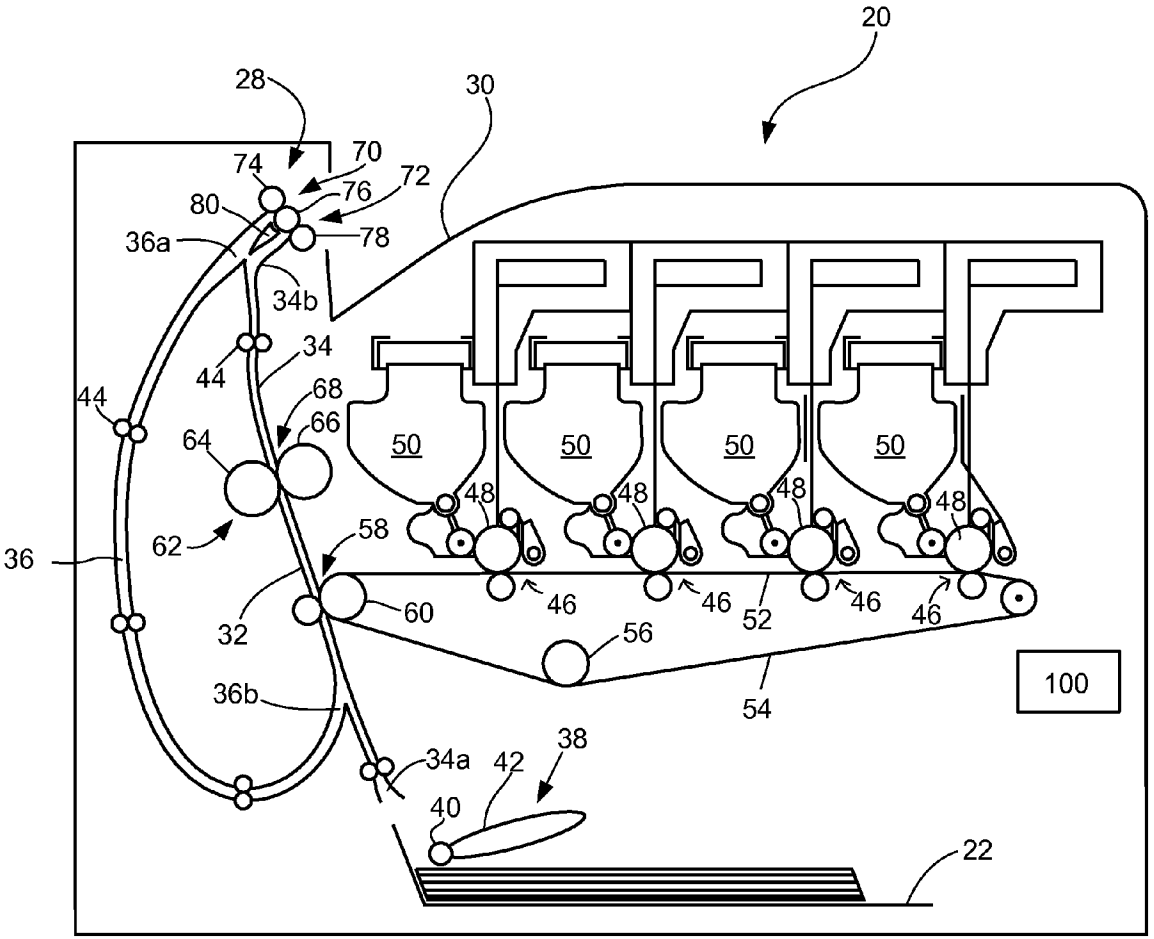
FIG. 2 shows a first schematic view of a media path of an imaging device according to one embodiment.
Figure 3:
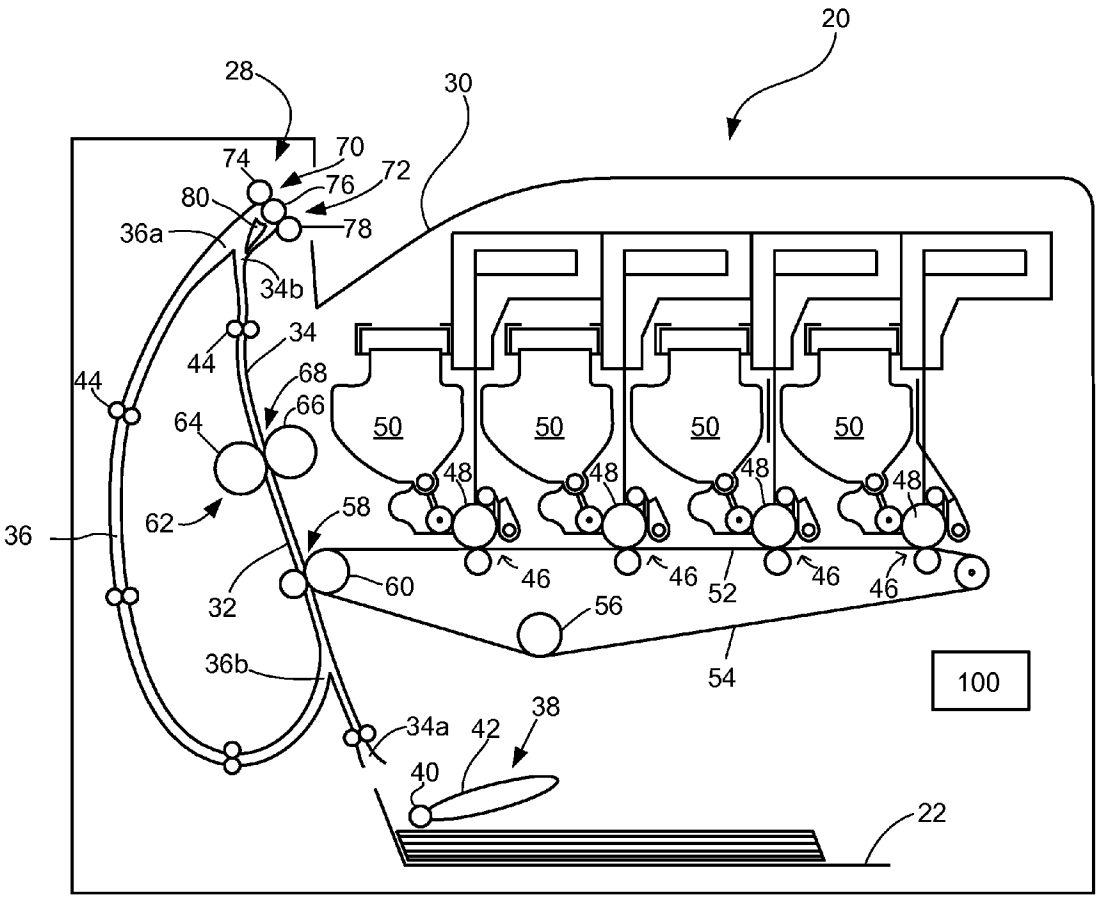
FIG. 3 shows a second schematic view of the media path shown in FIG. 2.

FIGS. 2 and 3 illustrate a schematic view of the interior of the example imaging device 20. A media path 32 extends through the imaging device 20 for moving the media sheets through the image transfer or scanning process. The media path 32 includes a simplex path 34 and a duplex path 36. A media sheet is introduced into an entrance 34*a* to the simplex path 34 from the tray 22 by a pick mechanism 38. In the example embodiment shown, the pick mechanism 38 includes a roll 40 positioned at the end of a pivotable arm 42. The roll 40 rotates to move the media sheet from the tray 22 and into the media path 32. The media sheet is then moved along the media path 32 by transport rollers 44.

Embodiments include those wherein the device 20 includes an image transfer section that includes one or more imaging stations 46. In the example embodiment illustrated, each imaging station 46 includes a photoconductor (PC) drum 48 that transfers charged toner from a toner reservoir 50 to an intermediate transfer member 52. The intermediate transfer member 52 is formed as an endless belt 54 trained about a series of rollers 56. As the intermediate transfer member 52 revolves, the belt 54 collects toner images from each PC drum 48 to form a complete toner image. The belt 54 then conveys the toner image to a media sheet at a transfer nip 58 formed between a pair of rollers 60. Alternatives include those wherein the toner images are applied directly to the media sheet by the PC drum(s) 48. After receiving the toner image, the media sheet is moved further along the media path 32 and into a fuser 62. The fuser 62 includes a fusing roll 64, or belt, and a backup roll 66 that form a fuser nip 68 to apply pressure and heat to the toner image on the media sheet as it passes through the fuser nip 68. The combination of heat and pressure fuses or adheres the toner image to the media sheet.

Alternative embodiments include those wherein the imaging station(s) 46 include a thermal inkjet device, a piezoelectric inkjet device, a dye sublimation device or any other image forming technology known in the art. Further alternatives include those wherein the imaging device 20 includes a scanning section in addition to or in place of the image transfer section.

After passing through the image transfer or scanning section, the media sheet is advanced to the exit path assembly 28. The exit path assembly 28 includes a first exit nip 70 formed by a first roller 74 and a second roller 76 and a second exit nip 72 formed by the second roller 76 and a third roller 78. The rotational direction of the first roller 74 and the third roller 78 are the same while the second roller 76 rotates in the opposite direction. Accordingly, the rotational direction of the first exit nip 70 is opposite that of the second exit nip 72. In the example embodiment illustrated, the first exit nip 70 is the top nip and the second exit nip 72 is the bottom nip. Alternative embodiments include those wherein this configuration is reversed such that the first exit nip 70 is the bottom nip and the second exit nip 72 is the top nip.

A moveable guide 80 is positioned between an exit 34*b* of the simplex path 34 and the exit path assembly 28 for directing the media sheet to either the first exit nip 70 or the second exit nip 72. Where imaging or scanning of the reverse side of the media sheet is not desired, the guide 80 directs the media sheet toward the second exit nip 72 for exiting the media sheet from the housing 24 into the output bin 30 (FIG. 2). Conversely, where imaging or scanning of a reverse side of the media sheet is desired, the guide 80 directs the media sheet toward the first exit nip 70 for performing a peek-a-boo duplex operation (FIG. 3). The media sheet is partially exited from the housing 24 by the first exit nip 70. After a trailing edge of the media sheet exits the simplex path 34 and the media sheet has been partially exited from the housing 24, the rotation of the first exit nip 70 is reversed to reenter the media sheet into the housing 24 and into an entrance 36*a* to the duplex path 36. The media sheet is then advanced through the duplex path 36 by a series of rollers 44 until it reaches an exit 36*b* of the duplex path 36 where it is reintroduced into the simplex path 34 for image transfer or scanning of the reverse side of the media sheet. The media sheet is then advanced back toward the guide 80. The guide 80 directs the media sheet toward the second exit nip 72 which outputs the media sheet from the housing 24 into the output bin 30 (FIG. 2).

Because the second exit nip 72 rotates inward as the first exit nip 70 rotates outward, the imaging device 20 is able to output a finished media sheet from the second exit nip 72 and perform a peek-a-boo duplex operation using the first exit nip 70 simultaneously. For example, where it is desired to perform duplex imaging on consecutive media sheets, a first media sheet is advanced along the simplex path 34 through the image transfer section. The guide 80 directs the first media sheet into the first exit nip 70 where it is partially exited from the imaging device 20 by the outward rotation of the first exit nip 70 and then reentered into the imaging device 20 and into the duplex path 36 by the inward rotation of the first exit nip 70. As the first media sheet is advanced into and along the duplex path 36, a second media sheet is advanced along the simplex path 34 through the image transfer section. The guide 80 directs the second media sheet into the first exit nip 70 where it is partially exited from the housing 24 by the outward rotation of the first exit nip 70. As the second media sheet is advanced into and through the first exit nip 70, the first media sheet is advanced from the duplex path 36 back through the simplex path 34 to receive an image on the reverse side of the media sheet. The second media sheet is then reentered into the imaging device 20 and into the duplex path 36 by the inward rotation of the first exit nip 70. As the second media sheet reenters the imaging device 20, the guide 80 directs the first media sheet into the second exit nip 72 where it is exited from the imaging device 20 into the output bin 30. This process continues until all desired media sheets have received duplex imaging.

A controller 100 oversees the functioning of the device 20. Controller 100 may include a microcontroller with associated memory. In one embodiment, controller 100 includes a processor, random access memory, read only memory, and an input/output interface. Controller 100 oversees the functioning of the imaging device 20 including movement of media along media path 32, the operation of the image transfer section and/or scanning section, the operation of the exit path assembly 28 and the guide 80, and the operation of the control panel 26.

Figure 4:
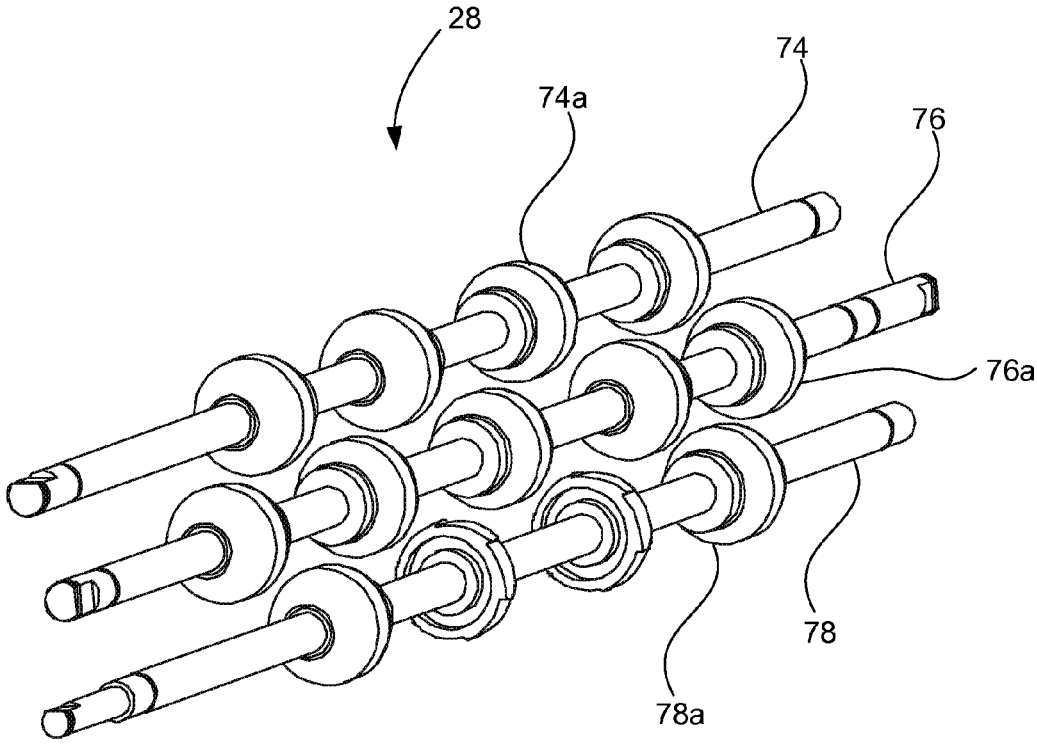
FIG. 4 shows a perspective view of an exit path assembly according to one embodiment.
Figure 5:
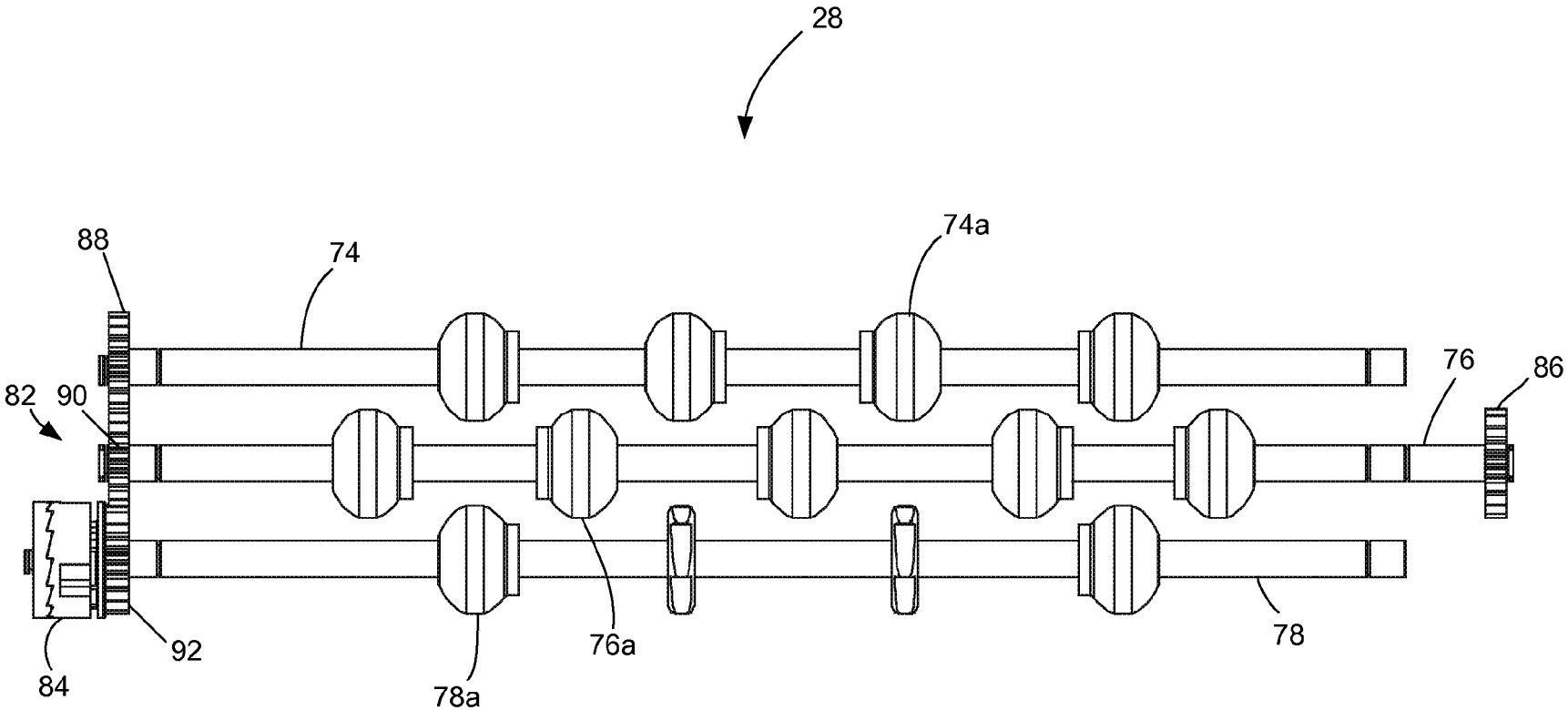
FIG. 5 shows a front elevation view of an exit path assembly according to one embodiment.

With reference to FIGS. 4 and 5, in some embodiments, at least one of the first and second exit nips 70, 72 is a corrugated nip. In the example embodiment shown in FIGS. 4 and 5, the first and second exit nips 70, 72 are corrugated nips. The spacing between adjacent rollers is relatively narrow such that the outer surface 74*a* of the first roller 74 overlaps with the outer surface 76*a* of the second roller 76 which overlaps with the outer surface 78*a* of the third roller 78. The overlap between adjacent rollers forms the corrugated nip. When a media sheet passes through a corrugated nip, a slight wrinkle, bend or fold is introduced across a length of the media sheet. The corrugation is temporary and occurs only when the media sheet is in the nip. This aids in preventing the media sheet from collapsing under its own weight as it is cantilevered outward from the first or second exit nip 70, 72. Where one media sheet is extended from the first exit nip 70 during a peek-a-boo duplex operation and another media sheet is exiting from the second exit nip 72 simultaneously, corrugation of the first exit nip 70 helps prevent the duplexing media sheet from folding down into contact with and disrupting the media sheet exiting the second exit nip 72. Corrugation of the second exit nip 72 helps prevent the media sheet exiting the second exit nip 72 from interfering with media sheets in the output bin 30 as the media sheet is advanced outward by the second exit nip 72.

The exit path assembly 28 includes a common drive linkage 82 for driving the rotation of the first, second and third rollers 74, 76, 78. In the example embodiment shown in FIG. 5, the second roller 76 includes a drive gear 86. The drive gear 86 is connected either directly or indirectly, such as by way of one or more gears, to a motor (not shown) that provides rotational force to the drive gear 86. Alternatives include those wherein the drive gear 86 is connected to the first roller 74. A first gear 88, second gear 90, and third gear 92 are connected to the first, second and third rollers 74, 76, 78, respectively. In the example embodiment illustrated in FIG. 5, the second gear 90 transfers the rotational force received from the motor by the drive gear 86 to the first gear 88 and the third gear 92 in order to drive the first roller 74 and the third roller 78. Alternatively, where the drive gear 86 is connected to the first roller 74, the first gear 88 transfers the rotational force received from the motor by the drive gear 86 to the second gear 90 and the third gear 92 in order to drive the second roller 76 and the third roller 78. In the example embodiment illustrated, the drive gear 86 is provided at an end of the rollers opposite that of the first, second and third gears 88, 90, 92. Alternatives include those wherein the drive gear 86 is located on the same end of the rollers as the first, second and third gears 88, 90, 92. Further, in those embodiments where the drive gear 86 is connected to the first roller 74, the first gear 88 may comprise the drive gear 86. It will be appreciated by those skilled in the art that the examples illustrated and discussed herein are intended to be illustrative rather than exhaustive and that additional intermediary gears and alternative configurations may be utilized in order to transfer rotational force between the rollers.

The drive linkage 82 includes a one-way clutch 84 coupled to the third roller 78 for limiting the drive of third roller 78 to one direction, termed the driven direction. In some embodiments, the clutch 84 prevents the third roller 78 from rotating in a direction opposite the driven direction. Alternatives include those wherein when the clutch 84 disengages, it freewheels thereby permitting the third roller 78 to rotate in a direction opposite the driven direction if a force were applied in such direction. Embodiments include those wherein an outer surface 76*a* of the second roller 76 is not in contact with an outer surface 78*a* of the third roller 78. This prevents the third roller 78 from being driven inward as a result of friction contact between the outer surfaces 76*a*, 78*a* of the second and third rollers 76, 78 when the clutch 84 is disengaged.

Figure 6:
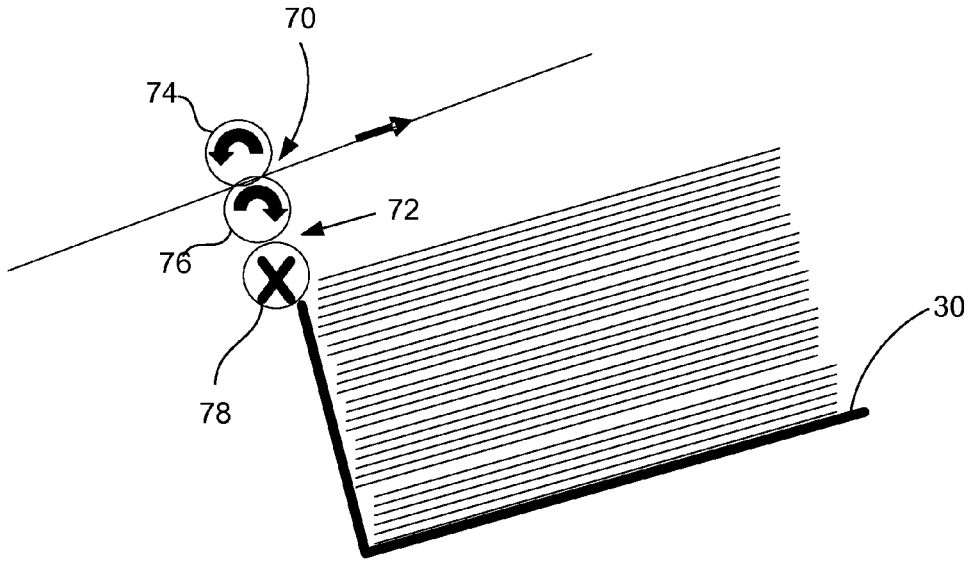
FIG. 6 shows a first schematic view of an exit path assembly according to one embodiment.
Figure 7:
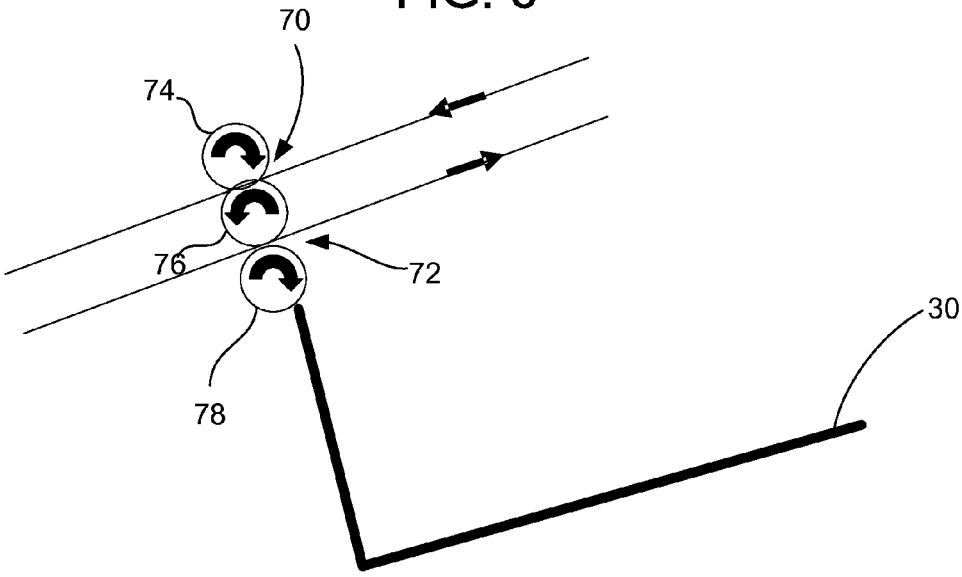
FIG. 7 shows a second schematic view of the exit path assembly shown in FIG. 6.

With reference to FIGS. 6 and 7, when the first exit nip 70 is driven outward, the clutch 84 disengages to prevent the third roller 78 from being driven inward. Accordingly, the third roller 78 remains stationary when a media sheet is partially exited from the housing 24 through the first exit nip 70 during a duplex operation. The stationary third roller 78 is not able to drive media and therefore prevents media in the output bin 30 from reentering the imaging device 20 through the second exit nip 72. When the first exit nip 70 is reversed and driven inward toward the housing 24, the clutch 84 engages to drive the third roller 78 and the second exit nip 72 outward allowing the second exit nip 72 to exit a media sheet to the output bin 30 as the first exit nip 70 completes the peek-a-boo duplex operation. Accordingly, it will be appreciated that the configuration of the clutch 84 prevents the media jams that may result from the reintroduction of a media sheet from the output bin 30 through the second exit nip 72 into the imaging device 20.

The foregoing description of an embodiment has been presented for purposes of illustration. It is not intended to be exhaustive or to limit the application to the precise forms disclosed, and obviously many modifications and variations are possible in light of the above teaching. It is understood that the invention may be practiced in ways other than as specifically set forth herein without departing from the scope of the invention. It is intended that the scope of the application be defined by the claims appended hereto.

What is claimed is:

1. An exit path assembly for an imaging device, comprising:

a first exit nip formed by a first roller and a second roller;

a second exit nip formed by the second roller and a third roller, the rotational direction of the second roller being opposite the rotational direction of the first and third rollers; and a common drive linkage for driving the rotation of the first, second and third rollers, the common drive linkage having a one-way clutch coupled to the third roller, wherein when the second roller is driven in a first rotational direction, the third roller is driven outward and when the second roller is driven in a second rotational direction opposite the first rotational direction, the clutch prevents the third roller from being driven.

2. The exit path assembly of claim 1, further comprising an output bin disposed on an exterior of the imaging device for receiving media from at least one of the first exit nip and the second exit nip, wherein the clutch prevents the third roller from being driven inward in order to prevent media in the output bin from entering the imaging device through the second exit nip.

3. The exit path assembly of claim 1, wherein the first exit nip is aligned with an entrance to a duplex path in the imaging device for reversing media into the duplex path and the second exit nip is for outputting media from the imaging device.

4. The exit path assembly of claim 1, wherein when the second roller is driven in the first rotational direction, the clutch is engaged to drive the third roller outward and when the second roller is driven in the second rotational direction, the clutch is disengaged to prevent the third roller from being driven.

5. The exit path assembly of claim 1, wherein an outer surface of the second roller is not in contact with an outer surface of the third roller.

6. The exit path assembly of claim 1, wherein at least one of the first exit nip and the second exit nip is a corrugated nip.

7. An exit path assembly for an imaging device, comprising:

a first exit nip formed by a first roller and a second roller for performing peek-a-boo duplex printing;

a second exit nip formed by the second roller and a third roller for outputting media sheets from the imaging device to an output bin disposed on an exterior of the imaging device, the rotational direction of the second roller being opposite the rotational direction of the first and third rollers; and a common drive linkage for driving the rotation of the first, second and third rollers, the common drive linkage having a one-way clutch coupled to the third roller, wherein when the second roller is driven in a first rotational direction, the third roller is driven outward and when the second roller is driven in a second rotational direction opposite the first rotational direction, the clutch prevents the third roller from being driven.

8. The exit path assembly of claim 7, wherein the clutch prevents the third roller from being driven inward in order to prevent media in the output bin from entering the imaging device through the second exit nip.

9. The exit path assembly of claim 7, wherein when the second roller is driven in the first rotational direction, the clutch is engaged to drive the third roller outward and when the second roller is driven in the second rotational direction, the clutch is disengaged to prevent the third roller from being driven.

10. The exit path assembly of claim 7, wherein an outer surface of the second roller is not in contact with an outer surface of the third roller.

11. The exit path assembly of claim 7, wherein at least one of the first exit nip and the second exit nip is a corrugated nip.

12. A method for transporting media in an imaging device, comprising:

driving a first roller and a second roller forming a first exit nip in first rotational directions opposite each other to permit the first exit nip to move media inward toward an interior of an imaging device housing while driving a third roller forming a second exit nip with the second roller in the same rotational direction as the first roller to permit the second exit nip to move media outward from the imaging device housing, the first, second and third rollers sharing a common drive linkage; and driving the first roller and the second roller forming the first exit nip in second rotational directions reversed with respect to the first rotational directions to permit the first exit nip to move media outward from the imaging device housing without driving the third roller.

13. The method of claim 12, further comprising:

partially exiting a first media sheet from the imaging device housing through the first exit nip without driving the third roller; and re-entering the first media sheet into the imaging device housing through the first exit nip while simultaneously exiting a second media sheet from the imaging device housing through the second exit nip.

14. The method of claim 13, further comprising transferring the second media sheet to an output bin disposed on an exterior of the imaging device housing.

15. The method of claim 14, further comprising preventing the second media sheet from reentering the imaging device housing after it has been transferred to the output bin.

16. The method of claim 13, further comprising entering the first media sheet into a duplex printing path in the imaging device housing.

17. The method of claim 12, further comprising engaging a one-way clutch coupled to the third roller when the first and second rollers are driven in the first rotational directions and disengaging the one-way clutch when the first and second rollers are driven in the second rotational directions.

18. The method of claim 12, wherein an outer surface of the second roller is not in contact with an outer surface of the third roller.

19. The method of claim 12, wherein at least one of the first exit nip and the second exit nip is a corrugated nip.

* * * * *